US006887003B2

(12) United States Patent
Someno

(10) Patent No.: US 6,887,003 B2
(45) Date of Patent: May 3, 2005

(54) PRINTING SYSTEM TO PRINT CONTINUOUS SHEET WITHOUT ANY MARGIN, AND TO AUTOMATICALLY CUT THE SHEET

(75) Inventor: Masahiro Someno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/244,107

(22) Filed: Sep. 16, 2002

(65) Prior Publication Data

US 2003/0072597 A1 Apr. 17, 2003

(30) Foreign Application Priority Data

Sep. 21, 2001 (JP) ..... 2001-289844

(51) Int. Cl.[7] ..... B41J 11/26; B41F 13/56; B26D 1/00; B26D 5/00

(52) U.S. Cl. ..... 400/621; 101/226; 101/227; 83/368; 83/34

(58) Field of Search ..... 400/621, 120, 400/279, 619, 149; 101/226, 227, 368, 181, 221, 490; 83/34, 268, 35, 368; 225/2, 106

(56) References Cited

U.S. PATENT DOCUMENTS 3,831,478 A * 8/1974 Wright et al. ..... 83/368
5,452,959 A * 9/1995 Oka ..... 400/149
5,615,959 A * 4/1997 Nishizawa et al. ..... 400/279
5,628,864 A * 5/1997 Kataigi et al. ..... 156/441.5
5,812,154 A * 9/1998 Kuboki ..... 347/5
5,826,474 A * 10/1998 Howard et al. ..... 83/105
6,146,035 A * 11/2000 Ishigouoka et al. ..... 400/621
6,168,108 B1 * 1/2001 Morley ..... 242/421.1
6,181,890 B1 * 1/2001 Kataoka et al. ..... 399/67

FOREIGN PATENT DOCUMENTS

DE 42 40 825 A1 * 4/1994 ..... B31D/1/02
JP 58197084 * 11/1983 ..... B41M/1/00
JP 2-121-861 * 5/1990 ..... B41J/1/42

* cited by examiner

*Primary Examiner*—Andrew H. Hirshfeld
*Assistant Examiner*—Wasseem H. Hamdan
(74) *Attorney, Agent, or Firm*—Sughrue Mion, PLLC

(57) ABSTRACT

A pattern of continuously printing a sheet without any margin between images and cutting a boundary between the images, a pattern of continuously printing the sheet with a margin between the images and performing two upper and lower cuttings at the places slightly inside the image around boundaries between the image and each of the margins, and a pattern of continuously printing the image obtained by cutting upper and lower ends of the original image without any margin between the images and cutting the boundary between the images are prepared beforehand. To execute the printing, an instruction as to the method for performing the printing is received from a user. This provides a printing system of printing the continuous sheet, subsequently automatically cutting the sheet, and outputting a standard-size printed matter without any margin, wherein the plurality of patterns can be switched regarding a printing mode and cut position of the image to complete the printing.

9 Claims, 10 Drawing Sheets

FIG.10

| | PRINTING AREA | MARGIN | CUTTING COMMAND PER IMAGE |
|---|---|---|---|
| PATTERN A | A4 WHOLE SURFACE | NONE | A4 LENGTH |
| PATTERN B | A4 WHOLE SURFACE | WIDTH a ADDED | A4 LENGTH - c<br>A4 LENGTH + ( d + e) |
| PATTERN C | UPPER END : CUT d<br>LOWER END : CUT e | NONE | A4 LENGTH − ( d + e ) |

PRINTING SYSTEM TO PRINT CONTINUOUS SHEET WITHOUT ANY MARGIN, AND TO AUTOMATICALLY CUT THE SHEET

TECHNICAL FIELD

The present invention relates to a printing system, particularly to a printing system which prints a continuous sheet without any margin, and automatically cuts the sheet.

BACKGROUND ART

In recent years, a technical development for realizing a printing without any margin in four sides with an ink jet printer has been advanced, and commercialized. The no-margin printing has been performed mainly on standard-size cut sheets such as A4, B5 (Japanese Industrial Standard, A4: 210×297 mm, B5: 182×257 mm) as objects, but the technical development of the no-margin printing has also been advanced with respect to continuous sheets such as a rolled sheet as the objects.

On the other hand, some types of printers, which print the rolled sheet, include a cutter for cutting the rolled sheet in a designated size after the printing, and automatically cut the rolled sheet after the printing.

In the meantime, there is no assumption of printing a rolled sheet, followed by automatically cutting, and outputting the printed matter with a predetermined size and without any margin, and such operation has not heretofore been performed. Therefore, there has been a demand for the operation of printing the rolled sheet, and automatically cutting the sheet, so that a standard-size printed matter having no margin is to be obtained. In this case, for the printing of the rolled sheet as the object, after different images are continuously printed on the same sheet, the sheet is cut, and separate printed matters are obtained. For this, various patterns have been considered with respect to printing modes of the continuous images and positions to be cut. Moreover, since printing results differ with the respective patterns, it is desirable to change the pattern in accordance with a purpose of printing.

DISCLOSURE OF THE INVENTION

An object of the present invention is to provide a printing system for printing a continuous sheet, subsequently automatically cutting the sheet, and outputting a standard-size printed matter without any margin, in which a plurality of patterns with respect to printing modes of an image and positions to be cut are switched to print the image.

To solve the above-described problem, according to the present invention, there is provided a printing system comprising: printing means for printing a continuous sheet based on printing data generated from image data; and cutting means for cutting the continuous sheet, the system further comprising:

printing mode control means for executing the printing according to a printing mode, which is selected based on an instruction from a user, out of the printing modes of:

a first printing mode in which a plurality of images are printed on the continuous sheet in a sheet feed direction without any margin and the continuous sheet is cut at a boundary between the images;

a second printing mode in which the plurality of images are printed on the continuous sheet in the sheet feed direction with margins and the continuous sheet is cut at two places inside the image in the vicinity of boundaries between the image and each of the margins with respect to one image; and a third printing mode in which the plurality of images obtained by cutting off upper and lower ends of an image area represented by the image data are printed on the continuous sheet in the sheet feed direction without any margin and the continuous sheet is cut at the boundary between the images.

Moreover, to solve the above-described problem, according to the present invention, there is provided a printer host which generates, based on image data, printing data for controlling a printer having printing means for printing a continuous sheet and cutting means for cutting the continuous sheet, the host further comprising:

mode control means for executing the printing data generation step according to a printing mode, which is selected based on an instruction from a user, out of the printing modes of:

a first mode for generating the printing data, which is used for printing a plurality of images on the continuous sheet in a sheet feed direction without any margin and for cutting the continuous sheet at a boundary between the images;

a second mode for generating the printing data, which is used for printing the plurality of images on the continuous sheet in the sheet feed direction with margins and cutting the continuous sheet in two places inside the image in the vicinity of boundaries between the image and each of the margins with respect to one image; and a third mode for generating the printing data, which is used for printing the plurality of images obtained by cutting off upper and lower ends of an image area represented by the image data on the continuous sheet in the sheet feed direction without any margin and cutting the continuous sheet at the boundary between the images is generated.

Additionally, the printing data generation step according to one mode, selected from any two modes out of the above-described three modes, may be executed based on the instruction from the user.

Here, in the aforementioned second mode, assuming that distances from the two places inside the image in the vicinity of each of the boundaries to the boundaries in the second mode are respectively referred to as a and b, and widths of the upper and lower ends cut in the third mode are respectively referred to as c and d, it is preferable to establish $a=c$ and $b=d$.

Moreover, assuming that an allowable error at the cut position of the printer including the cutting means for cutting the continuous sheet is referred to as e, it is preferable to establish $e<a$ and $e<b$.

Furthermore, assuming that the width of the margin added in the second mode is referred to as f, and a minimum cut width required for avoiding paper jam in the printer is referred to as g, it is preferable to establish $g \leqq a+b+f$.

BRIEF DESCRIPTION OF THE DRAWINGS

FIG. 10 is an explanatory view of contents of a printing area setting step (S1031), margin setting step (S1032), and cutting command setting step (S1033).

BEST MODE FOR CARRYING OUT THE INVENTION

An embodiment of the present invention will be described with reference to the drawings.

Figure 1:
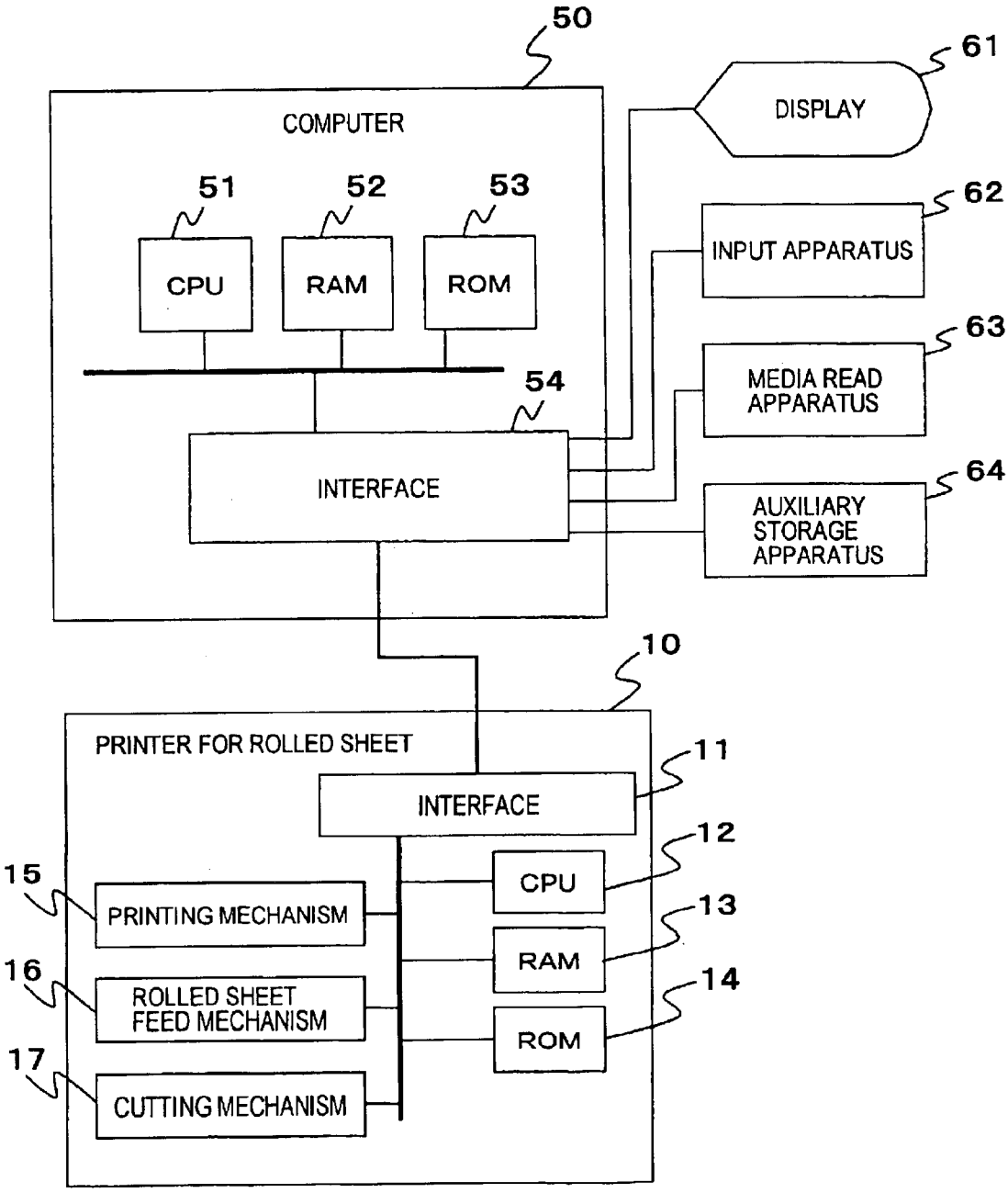
FIG. 1 is a block diagram showing an outline of a hardware configuration of a printing system to which the present invention is applied.

FIG. 1 is a block diagram showing an outline of a hardware configuration of a printing system to which the present invention is applied.

As shown in the figure, the printing system comprises: a computer 50 for executing various types of processing by application programs, printing processing by a printer driver, and the like; and a printer 10 for a rolled sheet, connected to the computer 50 (hereinafter referred to simply as the "printer 10"). In the present embodiment, the computer 50 functions as a printer host which generates printing data and transmits the data to the printer 10. The printer 10 performs a printing based on the printing data received from the computer 50. The printer 10 has a function of printing continuous sheets such as a rolled sheet without any margin and cutting the sheet in a designated size. Additionally, the configuration of the printing system is not limited to this. For example, a network printing system may be configured by connecting a plurality of computers 50.

The computer 50 comprises: a central processing unit (CPU) 51 which performs the processing based on various programs; a random access memory (RAM) 52 which temporarily stores data, a program, and the like; a read only memory (ROM) 53 which prestores in a nonvolatile manner various types of data for controlling the computer 50, start-up programs, and the like; and an interface 54 which manages transmission/reception of the data with peripherals such as the connected printer 10.

Moreover, the computer 50 is connected to: a display 61 such as a color display; an input apparatus 62 such as a mouse and a keyboard; a media read apparatus 63 which reads the data from a recording medium such as CD-ROM; and an internal or external auxiliary storage apparatus 64. Additionally, the configuration of the computer 50 is not limited to this.

For example, the printer 10 is an ink-jet color printer. The ink-jet color printer includes a plurality of ink cartridges in which a housing is filled with ink, and the ink is sprayed to printing media such as recording paper via a printing head to perform printing.

The printer 10 comprises: an interface 11 which manages a communication with the computer 50, such as reception of the data; a CPU 12 which performs the processing based on printing data, various programs, and the like; a RAM 13 which temporarily stores the printing data, and the like; a ROM 14 which prestores in a nonvolatile manner various types of data for controlling the printer 10, various programs, and the like; a printing mechanism 15 including a printing head which discharges the ink, a carriage driving mechanism which drives a carriage with the printing head mounted thereon, and the like; a rolled sheet feed mechanism 16 which supplies/delivers the rolled sheet; and a cutting mechanism 17 which cuts the rolled sheet. Additionally, the configuration of the printer 10 is not limited to this.

Here will be described an outline of the printing mechanism 15, rolled sheet feed mechanism 16, and cutting mechanism 17 of the printer 10 for the rolled sheet in the present embodiment.

Figure 2:
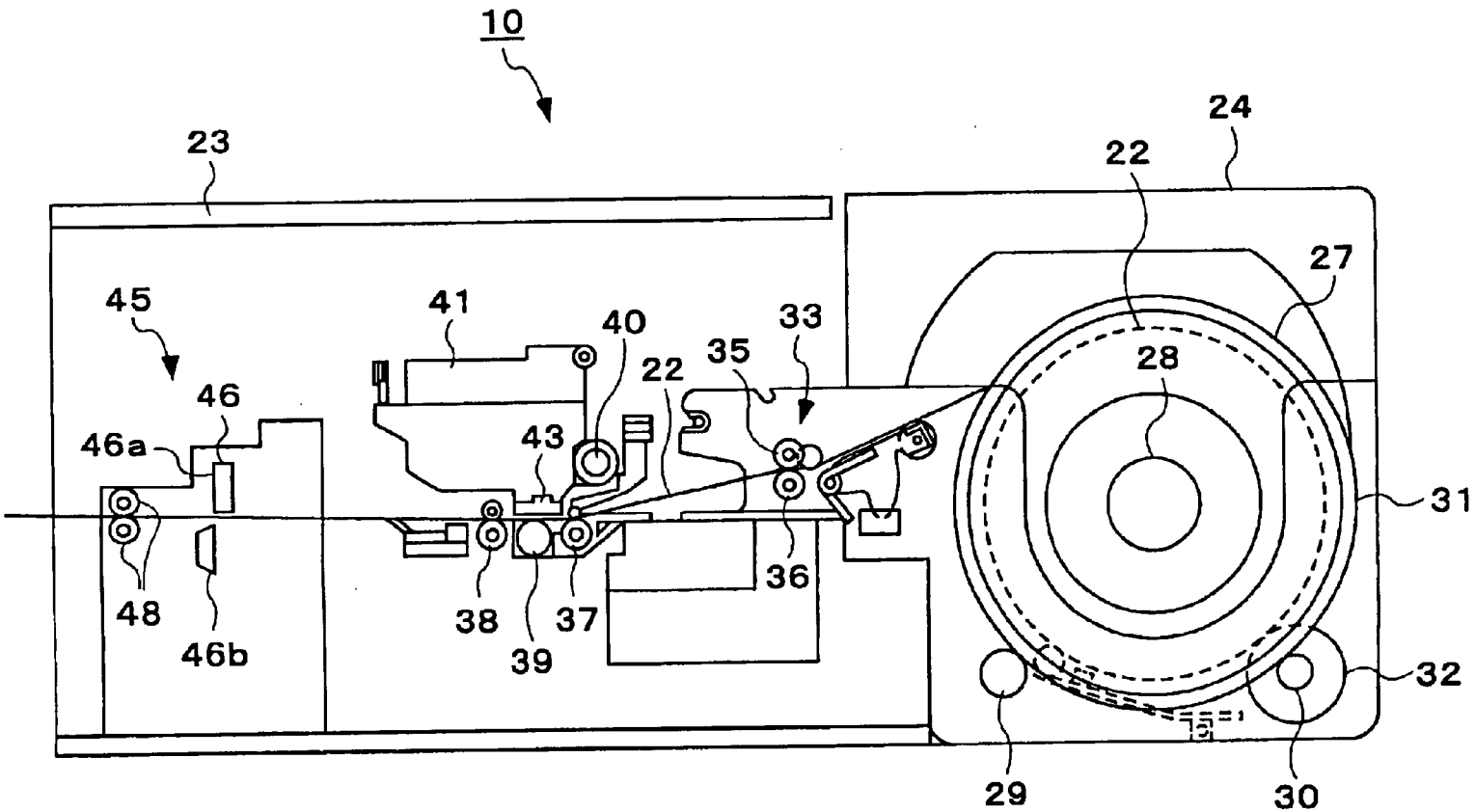
FIG. 2 is a side sectional schematic view of a printer 10 showing a printing mechanism 15, rolled sheet feed mechanism 16, and cutting mechanism 17.

FIG. 2 is a side sectional schematic view of the printer 10 showing the printing mechanism 15, rolled sheet feed mechanism 16, and cutting mechanism 17. The printer 10 for the rolled sheet comprises: an apparatus main body 23 including the printing mechanism 15 which prints a rolled sheet 22 as a recording sheet, rolled sheet feed mechanism 16 which feeds the rolled sheet, and cutting mechanism 17 which cuts the rolled sheet; and a rolled sheet cassette 24 in which the rolled sheet 22 is set.

The rolled sheet 22 is set in such a manner that it is attached by passing an axial portion 28 thereof through a tube 27 having a flange portion 31, and the flange portion 31 of the paper tube 27 contacts a pair of forward/backward rollers 29, 30 disposed in a bottom part of the rolled sheet cassette 24. A rolled sheet motor 32 which drives the driving roller 30 is disposed on a bottom rear side of the rolled sheet cassette 24. When the rolled sheet motor 32 is driven forwards, a turning force is transmitted to the flange portion 31 from the driving roller 30, and the rolled sheet 22 is rotated in a sheet feed direction. On the other hand, when the rolled sheet motor 32 is driven backwards, the turning force is transmitted to the flange portion 31 from the driving roller 30, and the rolled sheet 22 is rotated in a sheet windup direction.

In a front end of the rolled sheet cassette 24, a sheet feed apparatus 33 is disposed in a position corresponding to a conveyance path of the rolled sheet 22. The sheet feed apparatus 33 comprises a sheet feed driven roller 35 and sheet feed driving roller 36, and sends the rolled sheet 22 toward an apparatus main body 23 side. In the apparatus main body 23, a conveyance roller 37 and sheet delivering roller 38 are arranged from an upstream side. Mainly these portions configure the rolled sheet feed mechanism 16.

The apparatus main body 23 includes a carriage shaft 40, and the carriage shaft 40 slidably supports a carriage 41. A printing head 43 is attached to the lower surface of the carriage 41, and ink drops are discharged via nozzle holes (not shown) of the printing head 43 to print the rolled sheet 22. The printing head 43 is connected to ink cartridges (not shown) separate from the apparatus main body 23, and receives an ink supply from the ink cartridges. Moreover, a platen 39 is disposed between the conveyance roller 37 and sheet delivering roller 38 in a sheet feed direction. Mainly these portions configure the printing mechanism 15.

In the apparatus main body 23, a cutter apparatus 45 for cutting the printed rolled sheet 22 is disposed. The cutter apparatus 45 comprises a cutter 46 including a movable blade 46*a* and a fixed blade 46*b*. Engages with the fixed blade 46*b*, the movable blade 46*a* moves in a width direction of the rolled sheet 22 (direction crossing at right angles to the sheet feed direction) to cut the rolled sheet 22. The rolled sheet 22 cut by the cutter 46 is delivered to the outside of the apparatus main body 23 by auxiliary driving rollers 48 of the cutter apparatus 45. Mainly these portions configure the cutting mechanism 17. Additionally, the cutter apparatus 45 may be attached to the outside of the apparatus main body 23.

The printing mechanism 15 is controlled by the CPU 12, which executes a drawing command included in the printing data sent from the computer 50. That is, when the computer 50 transmits the printing data including the drawing command to the printer 10, an optional image can be printed in an optional area of the recording sheet.

Moreover, the rolled sheet feed mechanism 16 and cutting mechanism 17 are controlled by the CPU 12, which executes a rolled sheet feed command and cutting command included in the printing data sent from the computer 50. That is, when the computer 50 transmits the printing data including the rolled sheet feed command and the cutting command to the printer 10, the printer 10 is allowed to feed an optional amount of the rolled sheet and to cut the sheet in the optional position of the rolled sheet.

A functional configuration implemented by the computer 50 and the printer 10 in the above-described printing system will next be described next with reference to a block diagram of FIG. 3.

As shown in the drawing, an application portion 510 and printer drive portion 520 are constructed on the computer 50.

The application portion 510 has a function of allowing the computer 50 to perform a processing such as a word processor and graphics, and is constructed on the computer 50, when an application program read by the RAM 52 is executed by the CPU 51.

The printer drive portion 520 has a function of reading image data generated by the application portion 510, converting the data to the printing data having a format which can be interpreted by the printer 10, and transmitting the data to the printer 10 via the interface 54.

For this purpose, the printer drive portion 520 includes: a rasterizer processing section which draws the image data generated by the application portion 510 into the image data as an aggregate of dots; a halftone processing section which performs a color conversion processing and halftone processing of the image data; a command conversion section for converting the image data to the printing data to control the printer 10 so that the processed image data is printed; and a user interface section which receives a printing setting from a user (not shown).

Moreover, in the present embodiment, the printer drive portion 520 includes functions of a printing area setting section 521, margin setting section 522, and cutting command setting section 523.

The printing area setting section 521 performs a processing for setting a size (printing area) of the image represented by the printing data with respect to a designated sheet size.

The margin setting section 522 performs a processing for setting presence/absence of a margin between continuous images, and a size of the margin.

The cutting command setting section 523 performs a processing for setting a position to cut between the continuous images.

The printer drive portion 520 is constructed on the computer 50, when the CPU 51 executes a printer driver program read by the RAM 52. The printer driver program for this purpose is recorded, for example, in a portable recording media such as CD-ROM and can thereby be distributed. Moreover, when the media read apparatus 63 reads the program on the recording medium, the printer driver can be installed in the computer 50. Furthermore, for example, the printer driver can also be installed via computer networks such as the Internet.

Figure 3:
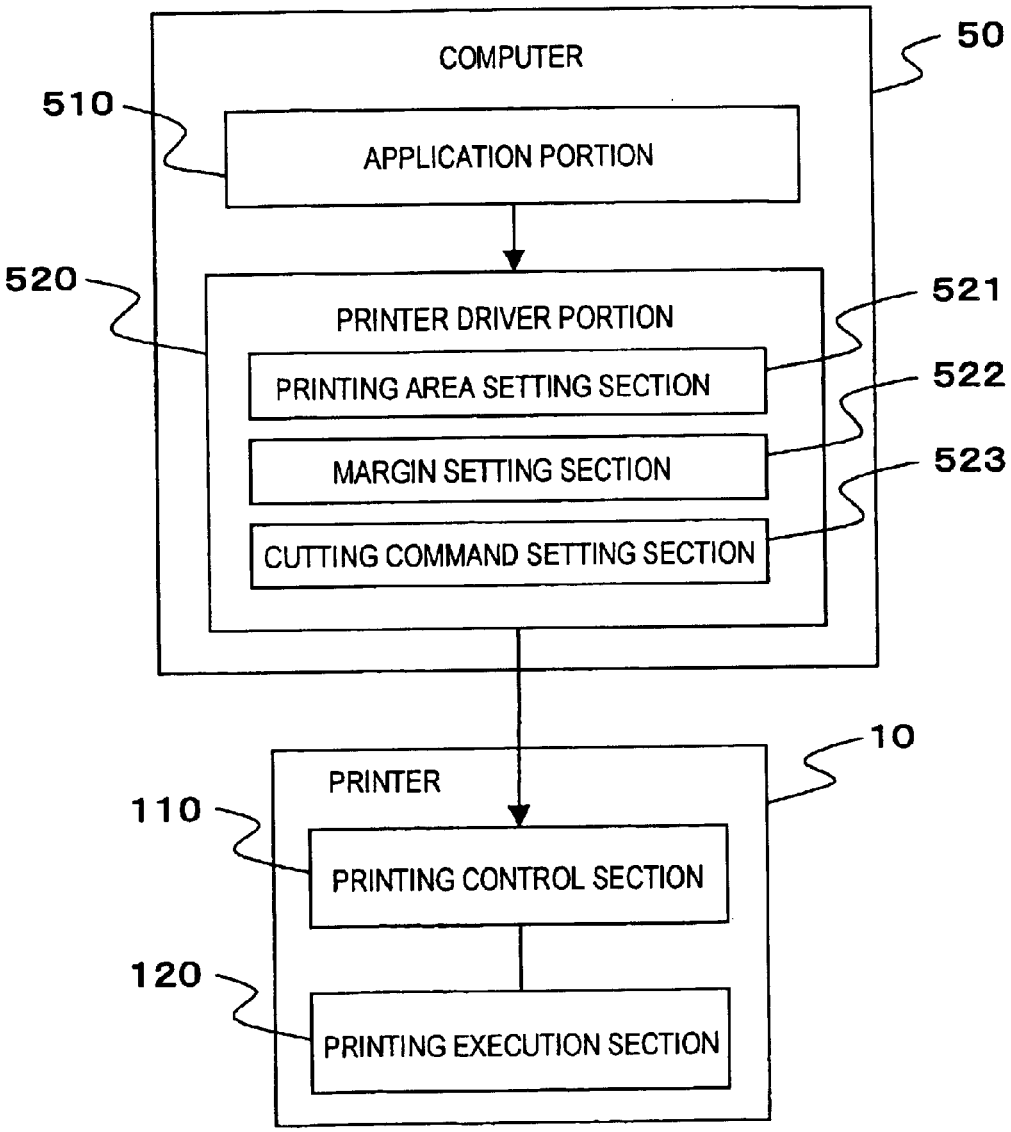
FIG. 3 is a block diagram showing a functional configuration implemented by a computer 50 and the printer 10.

In FIG. 3, on the printer 10, a printing control section 110 and printing execution section 120 are constructed.

The printing control section 110 is implemented by the CPU 12, interprets the printing data transmitted from the computer 50, and performs a control such that the printer 10 executes the printing based on the printing data.

The printing execution section 120 is implemented by the printing mechanism 15, rolled sheet feed mechanism 16, and cutting mechanism 17, and prints the rolled sheet 22 according to an instruction of the printing control section 110.

A printing pattern performed in the present embodiment will be described next. In the present embodiment, the image is continuously printed on the rolled sheet 22, and the sheet is cut, so that the printing without any margin is executed. In this case, as a printing pattern, it is possible to select one from three patterns (pattern A, pattern B, pattern C) based on a continuous printing manner and a cutting manner. In the following description, a portrait printing of an A4 size will be described as an example. That is, the A4 portrait image is continuously printed on the rolled sheet 22, and the sheet is cut between the images, so that a printed matter with an A4 size is obtained. This case will be described below. Of course, the present invention is not limited to this size and the printing orientation.

Figure 4:
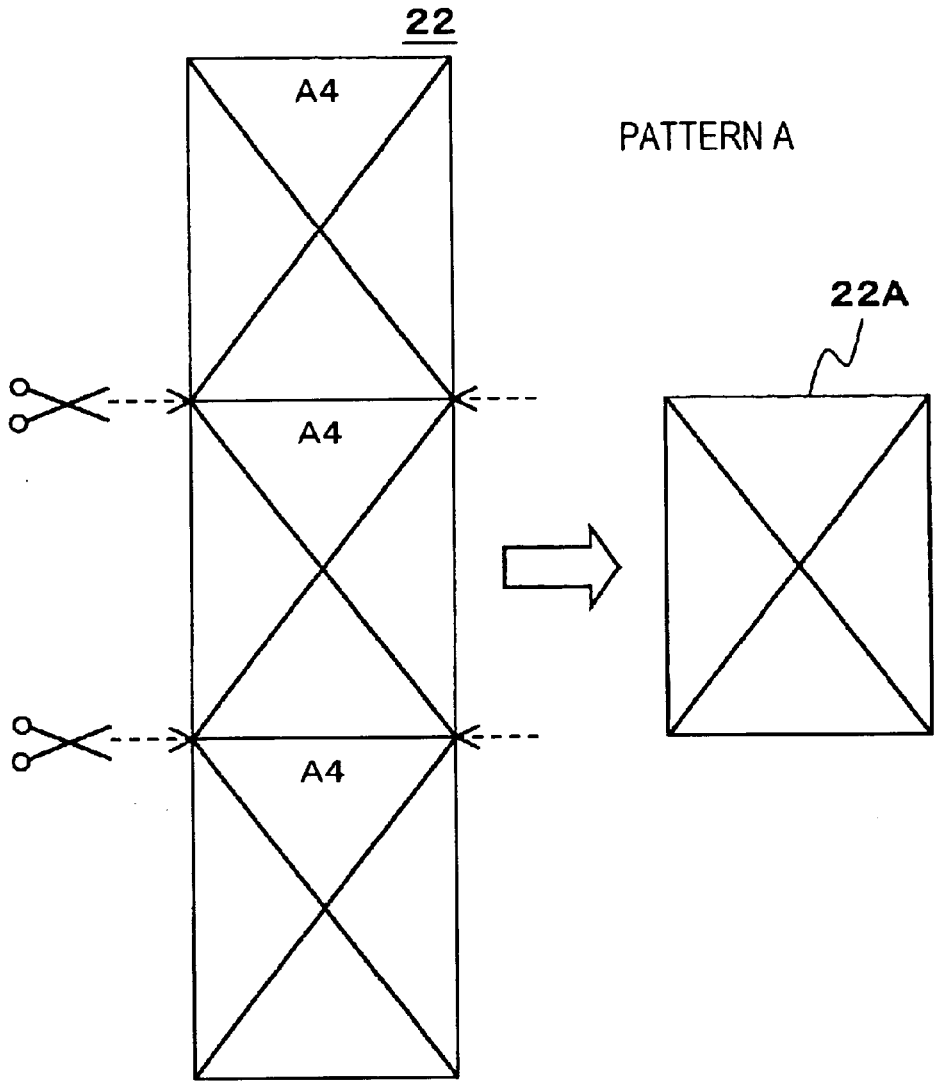
FIG. 4 is an explanatory view of a printing pattern A.

First, the pattern A will be described with reference to FIG. 4. The pattern A is a procedure in which the A4-size image is continuously printed on the rolled sheet 22 without any margin between the images, and a boundary between the images is cut. According to the pattern A, an A4-size printed matter 22A having no margin is obtained.

In general, since the cutting mechanism 17 has a precision error, for example, of about 0.3 mm, a part of a previous/subsequent image sometimes may enter the upper/lower end of the printed matter 22A, according to the pattern A.

Moreover, in order to remove a transverse margin portion, the image is printed in such a manner that a width of the image protrudes slightly from the rolled sheet 22. Therefore, the rasterizer processing section of the printer drive portion 520 generates the printing data for printing the image which has a width slightly longer than the width of the rolled sheet 22. This also applies to the following pattern B and pattern C.

Figure 5:
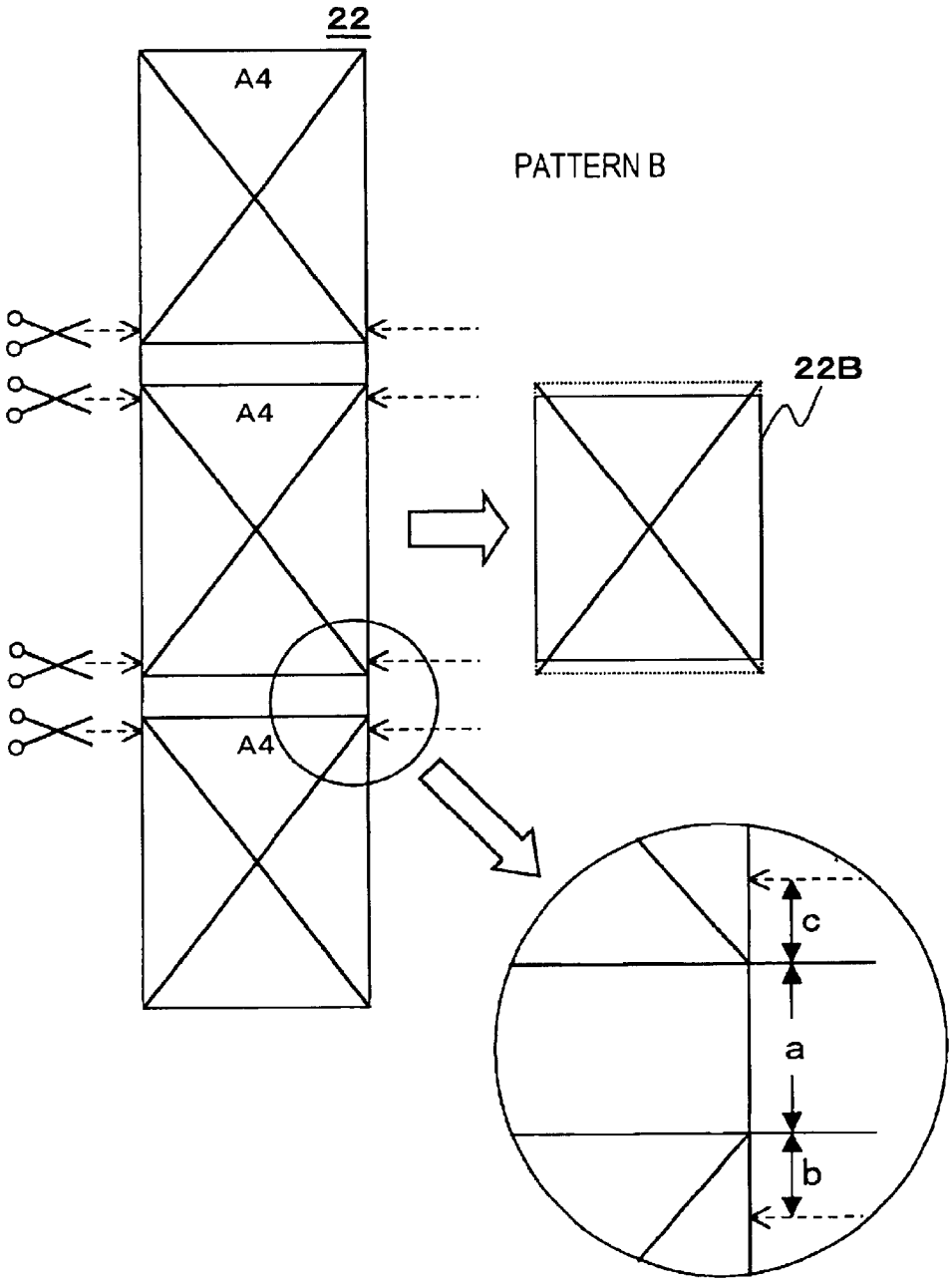
FIG. 5 is an explanatory view of a printing pattern B.

The pattern B for preventing the previous/subsequent image from protruding will be described next with reference to FIG. 5. The pattern B is a procedure in which the A4-size image is continuously printed on the rolled sheet 22 with a margin disposed between the images, and upper and lower places, i.e., two places are cut, slightly inside the image around each boundary between the image and each margin. The distance from the place slightly inside the image to the boundary between the image and margin is set to be larger than the error of the cutting mechanism 17, so that the margin can be prevented from being entered in the image (therefore, the upper/lower end of the image is cut off). Here, a width of the margin is assumed to be a, a distance from the boundary between the image and margin to a position at which the upper end of the image is cut is assumed to be b, and a distance from the boundary to a position at which the lower end of the image is cut is assumed to be c. To prevent the margin from being entered in the image, for example, b can be set to 3 mm, and c can be 5 mm. According to the pattern B, a no-margin printed matter 22B having a size with a length slightly (e.g., b+c=8 mm) shorter than the A4 size is obtained.

Additionally, in the pattern B, since two cuttings are performed with respect to one image, a paper chip having a width of a+b+c is generated between the images. In general, in the cutting mechanism 17, with a short paper chip with a width, for example, less than 18 mm, there is a possibility that paper jam occurs in the mechanism. Therefore, it is preferable to set a+b+c, for example, to 18 mm or more. That is, when b is 3 mm, and c is 5 mm, a width a of the margin is preferably 10 mm or more.

Figure 6:
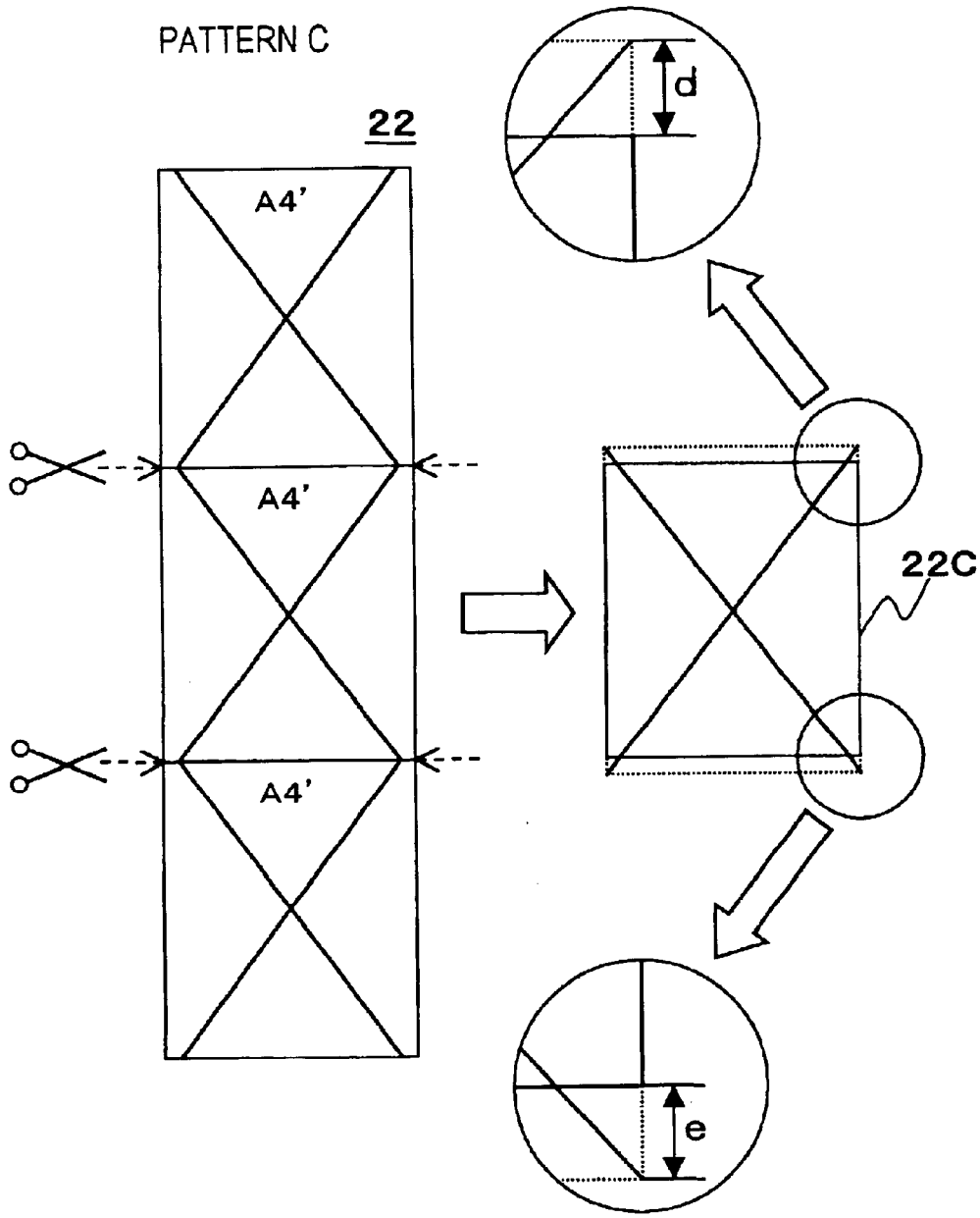
FIG. 6 is an explanatory view of a printing pattern C.

The printed matter according to the pattern A is different from the printed matter according to the pattern B in size and how the upper/lower chip of the image is cut off. Then, the pattern C will be described with reference to FIG. 6. The pattern C is a manner in which one cutting is performed with respect to one image like the pattern A, and the size of the printed matter and a manner of cutting off the upper/lower chip of the image are achieved similarly as the pattern B. The pattern C is a system in which the image obtained by cutting the upper and lower ends of the A4-size original image is continuously printed on the rolled sheet 22 without any margin between the images, and the boundary between the images is cut. That is, in a stage in which the computer 50 prepares the printing data, the printing data for printing the image whose upper and lower ends are cut off and whose length is made smaller than the A4 size is prepared.

Here, assuming that a cut-off width of the upper end is d, and a cut-off width of the lower end is e, d is set to the same value as that of b in the pattern B (e.g., 3 mm), and e is set to the same value as that of c in the pattern B (e.g., 5 mm). According to the pattern C, the printed matter having the same size and printing area as those of the pattern B, that is, a no-margin printed matter 22C with a size having a length slightly (e.g., d+e=8 mm) smaller than the A4 size is obtained.

Here, even with the pattern C, similarly as the pattern A, a part of the previous/subsequent image sometimes appears in the upper/lower end of the printed matter 22C.

Basically, when the user selects the pattern B or C, the printed matter having the same size and printing area can be obtained in either case. That is, when the user does not desire a part of the adjacent image appearing in the upper/lower end of the image, the user selects the pattern B. When the user does not desire a generation of the paper chip, the user can select the pattern C.

Figure 7:
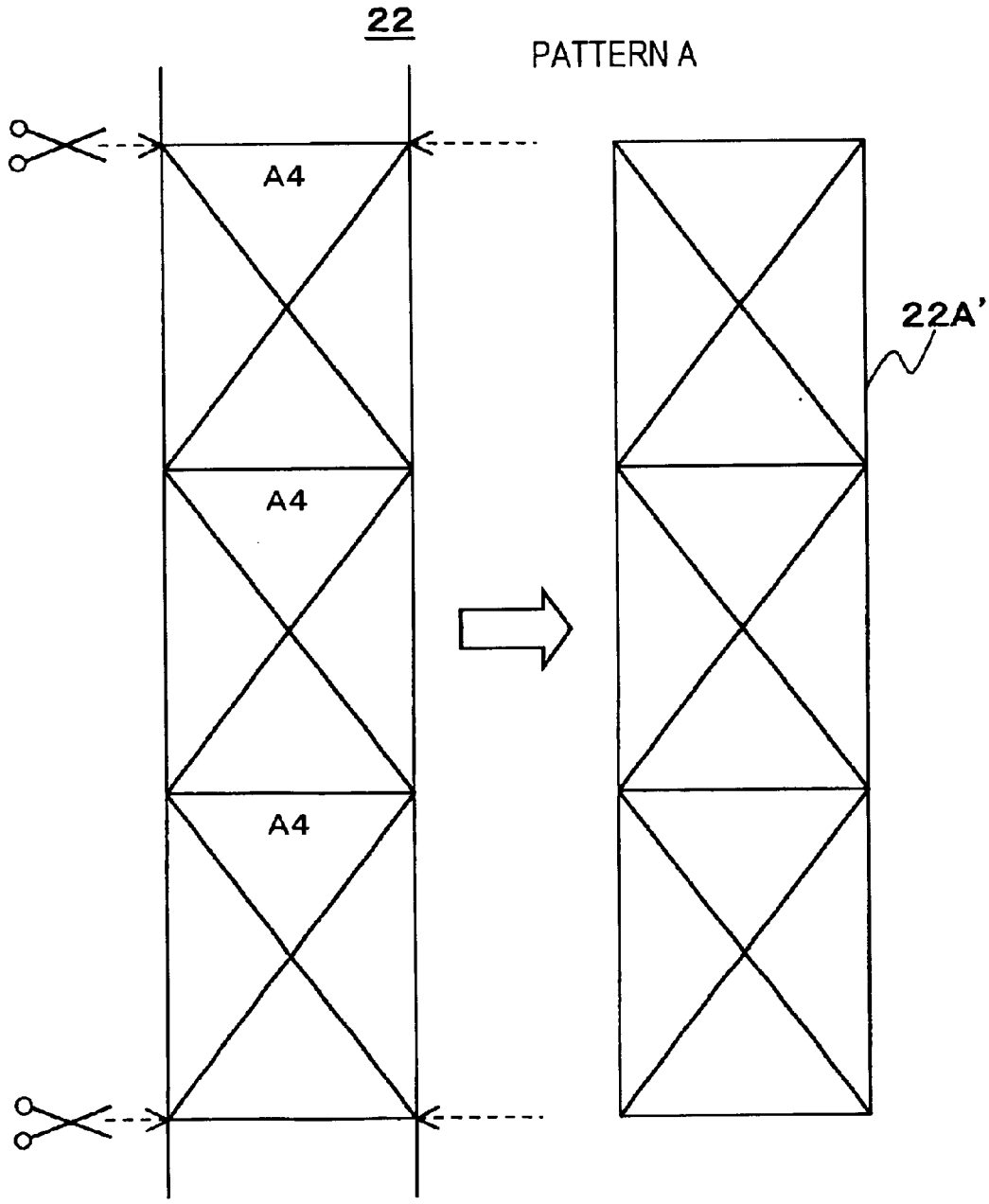
FIG. 7 is an explanatory view of a long-length printing performed according to the printing pattern A.

Moreover, if the user accepts a size and printing area different from those of the printed matter of the pattern B or C, the user can select the pattern A. Particularly, for the patterns B and C, an upper/lower part of the image is cut off. Therefore, to perform a long-length printing 22A' as shown in FIG. 7, the pattern A is preferably selected in which the continuous image is printed without being interrupted.

Additionally, the printer drive portion 520 does not have to provide all the patterns A, B and C to the user. For example, the patterns A and B, patterns B and C, or patterns A and C may also be provided to the user.

Figure 8:
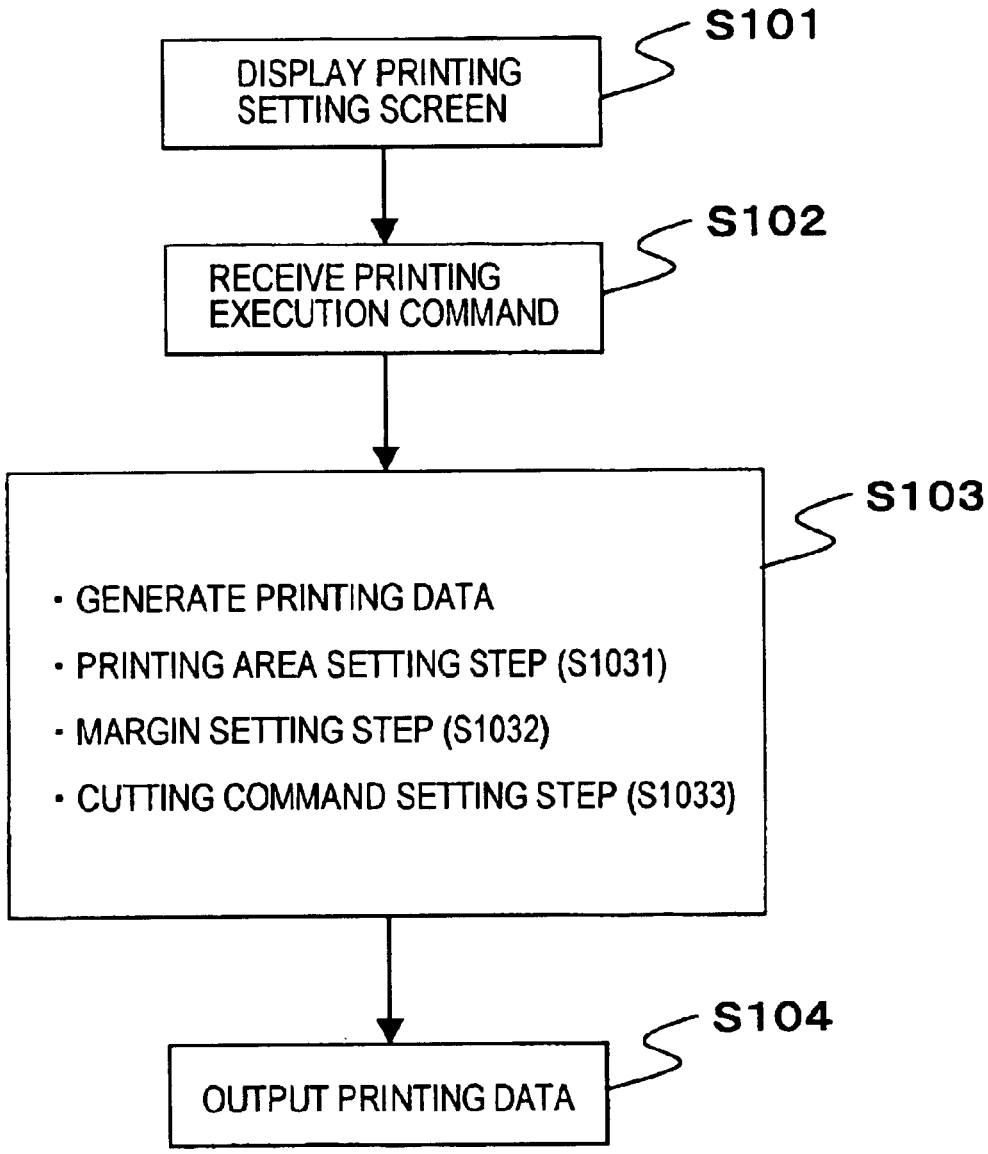
FIG. 8 is a flowchart showing a characteristic operation when a printer drive portion 520 performs a printing step in the present embodiment.

A characteristic operation of the printer drive portion 520 in the present embodiment to perform a printing step will be described next with reference to a flowchart of FIG. 8.

Figure 9:
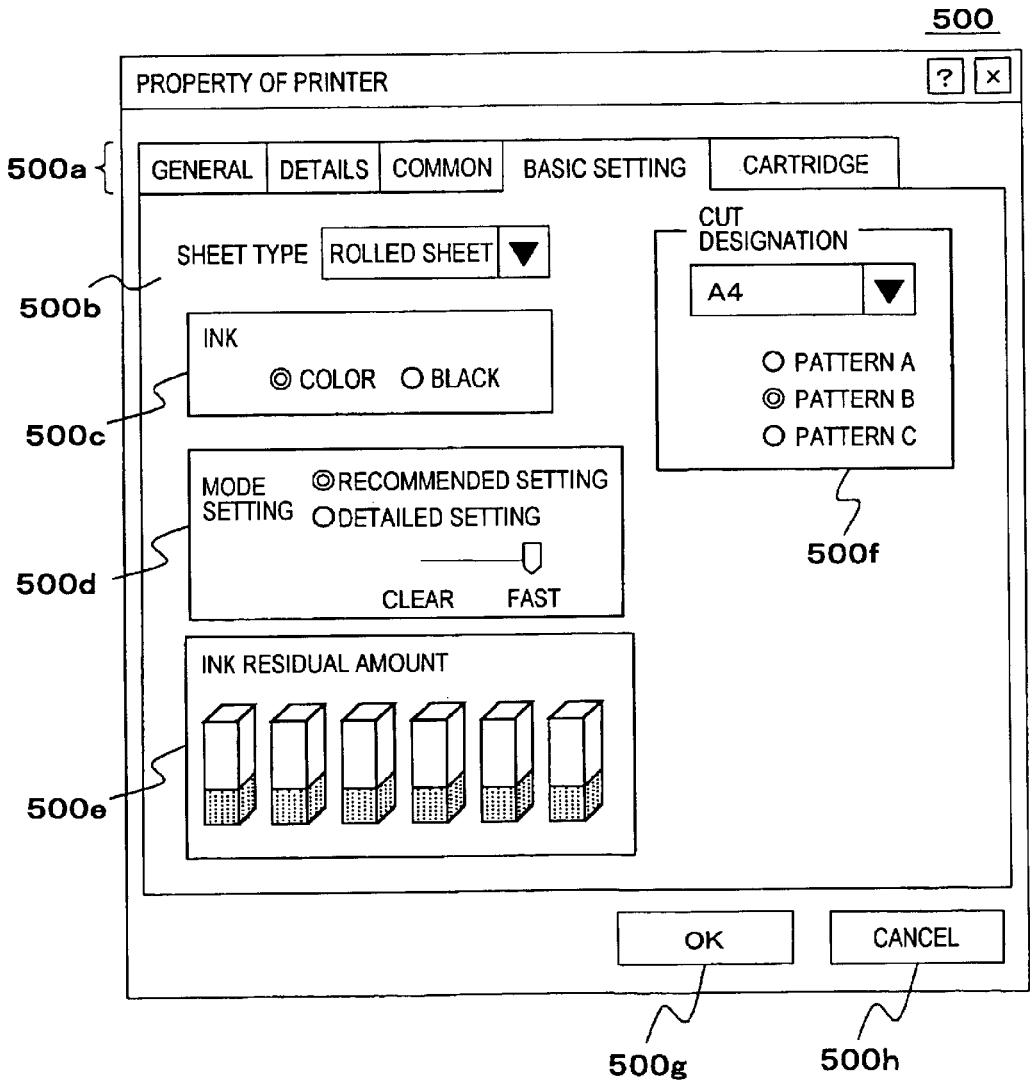
FIG. 9 is an explanatory view of one example of a printing setting screen 500.

For example, when the printer drive portion 520 receives a demand for a printing setting from the user via a menu command of the application portion 510, the user interface section of the printer drive portion 520 displays a printing setting screen 500 in the display 61 as shown in one example of FIG. 9, and receives the printing setting from the user (S101).

As shown in FIG. 9, the printing setting screen 500 is a screen for setting basic contents regarding the printing setting. For example, a sheet type 500*b,* ink mode 500*c,* printing mode 500*d,* and the like can be set. Here, as to the sheet type 500*b,* for example, when any one of the rolled sheet, plain paper, postcard, quality paper, and the like is selected from the menu, the type can be set. In the present embodiment, the rolled sheet is selected. In the ink mode 500*c,* it is set either a color printing or a monochromatic printing. In the printing mode setting 500*d,* it is possible to simply set a high-resolution printing or a high-speed printing. Moreover, when a detailed setting column is selected, a further detailed setting can be performed regarding a printing quality.

In the present embodiment, when the rolled sheet is selected in the sheet type 500*b,* it is possible to set a cut designation column 500*f.* In the cut designation column 500*f,* the size of one image and one of the printing patterns A to C can be selected. The size of one image can be set, for example, to the A4 size. Moreover, a long-length printing, or the optional size can also be designated.

Furthermore, the present screen 500 includes: a tab portion 500*a* for displaying screens for setting other items regarding the printing; a column 500*e* for displaying an ink residual amount of the printer 10; an "OK" button 500*g* for storing the set contents; and a "cancel" button 500*h* for canceling the set contents.

When the printer drive portion 520 receives a command for printing execution from the user, for example, via the menu command of the application portion 510 (S102), the printer driver 520 generates printing data for printing document being processed in the application portion 510 (S103).

In the printing data generation step, in addition to a usually performed rasterization step by the rasterizer processing section, and color conversion processing step by the halftone processing section, a printing area setting step (S1031), margin setting step (S1032), and cutting command setting step (S1033) are performed in the present embodiment. Additionally, these thee steps are added, only when the rolled sheet is selected in the sheet type 500*b.*

Contents of the printing area setting step (S1031), margin setting step (S1032), and cutting command setting step (S1033), are determined based on the setting in the cut designation column 500*f* of the printing setting screen 500.

FIG. 10 is an explanatory table showing the contents of each step. Here, an example in which the A4 size is selected as the size of one image in the cut designation column 500*f* will be described. Moreover, a to e in the table indicate predetermined lengths, and specific numeric values such as a=15 mm are used as described above.

When the printing pattern A is selected in the cut designation column 500*f,* the printing area setting section 521 sets an A4 whole surface as a printing area in the printing area setting step (S1031). Moreover, in the margin setting step (S1032), the margin setting section 522 sets the margin to 0. That is, the margin portion is not added. Furthermore, in the cutting command setting step (S1033), the cutting command setting section 523 sets a cutting command for executing the cutting in the position of the length of A4 for one image. That is, the cutting command is set so as to perform the cutting every length of A4 (boundary between the images). Here, in the cutting command, it is possible, for example, to use the lower end of the image to be printed as a reference, and the command can be set based on an offset value of the cutting position. Of course, this is not limited to this. In short, as long as the cutting is performed on the proper position as described above, by the cutting mechanism 17 of the printer 10, any other cutting command is possible.

When the printing pattern B is selected in the cut designation column 500*f*, the printing area setting section 521 sets the A4 whole surface as the printing area in the printing area setting step (S1031). Moreover, in the margin setting step (S1032), the margin setting section 522 sets the margin to the width a. That is, the printing data for printing the margin with the width a between the images is added. Furthermore, in the cutting command setting step (S1033), the cutting command setting section 523 sets the cutting command such that two cutting positions of A4 length−c, and A4 length+a+b (two upper/lower places slightly inside the image from the boundaries between the image and each margin) are executed with respect to one image.

When the printing pattern C is selected in the cut designation column 500*f*, the printing area setting section 521 sets an area obtained by cutting off the upper end of the A4 whole surface by a length of d and the lower end thereof by a length of e as the printing area in the printing area setting step (S1031). The rasterizer processing section generates the printing data for printing the image within the range out of the original image. Subsequently, in the margin setting step (S1032), the margin setting section 522 sets the margin to 0. That is, the margin portion is not added. Moreover, in the cutting command setting step (S1033), the cutting command setting section 523 sets the cutting command such that the position of A4 length−(d+e) (boundary between the images) is cut with respect to one image.

In this manner, the printing data generated in the printing data generation step (S103) is outputted to the printer 10 (S104). Subsequently, since the printing and cutting steps are performed based on the printing data received by the printer 10, the printed matter can be obtained in accordance with each printing pattern.

As described above, according to the present invention, there is provided a printing system for printing the continuous sheet, subsequently automatically cutting the sheet, and outputting the standard-size printed matter without any margin, wherein a plurality of patterns are switched with respect to the printing mode and cut position of the image to complete printing.

What is claimed is:

1. A printing system comprising:

printing means for printing a continuous sheet based on printing data generated from image data;

cutting means for cutting the continuous sheet; and printing mode control means for executing the printing according to a printing mode, which is selected, based on an instruction from a user, out of at least two printing modes comprising:

a first printing mode in which a plurality of images are printed on the continuous sheet in a sheet feed direction without any margin and the continuous sheet is cut at a boundary between the images;

a second printing mode in which a plurality of images are printed on the continuous sheet in the sheet feed direction with margins and the continuous sheet is cut at two places inside the image in the vicinity of boundaries between the image and each of the margins with respect to one image; and a third printing mode in which a plurality of images obtained by excluding upper and lower ends of an image area represented by the image data are printed on the continuous sheet in the sheet feed direction without any margin and the continuous sheet is cut at a boundary between the images.

2. A printer host which generates printing data based on image data for controlling a printer having printing means for printing a continuous sheet and cutting means for cutting the continuous sheet, the host comprising:

mode control means for executing a printing data generation process according to a printing mode, which is selected, based on an instruction from a user, out of at least two printing modes comprising:

a first mode for generating the printing data, which is used for printing a plurality of images on the continuous sheet in a sheet feed direction without any margin and for cutting the continuous sheet at a boundary between the images;

a second mode for generating the printing data, which is used for printing a plurality of images on the continuous sheet in the sheet feed direction with margins and cutting the continuous sheet in two places inside the image in the vicinity of boundaries between the image and each of the margins with respect to one image; and a third mode for generating the printing data, which is used for printing a plurality of images obtained by excluding upper and lower ends of an image area represented by the image data on the continuous sheet in the sheet feed direction without any margin and cutting the continuous sheet at the boundary between the images.

3. The printer host according to claim 2, wherein;

when distances from the two places inside the image to the boundaries in said second mode are respectively referred to as a and be, and widths of the upper and lower ends cut in said third mode are respectively referred to as c and d, then a=c and b=d are established.

4. The printer host according to claim 2, wherein:

when distances from the two places inside the image to the boundaries in said second mode are respectively referred to as a and b, and an allowable error at the cut position of the printer including the cutting means for cutting said continuous sheet is referred to as e, then e<a and e<b are established.

5. The printer host according to claim 3 or 4, wherein:

when the width of a margin added in said second mode is referred to as f, and a minimum cut width required for avoiding paper jam in said printer is referred to as g, then g<a+b+f is established.

6. A recording medium in which a printing driver is recorded to allow a computer to execute a process of generating printing data for controlling a printer, including printing means for printing a continuous sheet and cutting means for cutting the continuous sheet based on image data, wherein said printer driver allows the computer to execute a printing data generation process according to a printing mode, which is selected, based on an instruction from an user, out of at least two printing modes comprising:

a first mode for generating the printing data, which is used for printing a plurality of images on the continuous sheet in a sheet feed direction without any margin and for cutting the continuous sheet at a boundary between the images is generated;

a second mode for generating the printing data, which is used for printing a plurality of images on the continuous sheet in the sheet feed direction with margins and cutting the continuous sheet at two places inside the image in the vicinity of boundaries between the image and each of the margins with respect to one image; and a third mode for generating the printing data, which is used for printing a plurality of images obtained by excluding upper and lower ends of an image area represented by the image data on the continuous sheet in the sheet feed direction without any margin and cutting the continuous sheet at the boundary between the images.

7. The recording medium according to claim 6 wherein said printer driver assumes that distances from the two places inside the image to the boundaries in said second mode are respectively referred to as a and b, and widths of the upper and lower ends cut in said third mode are respectively referred to as c and d, then a=c and b=d are established.

8. The recording medium according to claim 6 wherein said printer driver assumes that distances from the two places inside the image to the boundaries in said second mode are respectively referred to as a and b, and an allowable error of the cut position of the printer including the cutting means for cutting said continuous sheet is referred to as e, then $e<a$ and $e<b$ are established.

9. The recording medium according to claim 7 or 8 wherein said printer driver assumes that the width of a margin added in said second mode is f, and a minimum cut width causing no paper jam in said printer is g, then $g \leqq a+b+f$ is established.

* * * * *